US007137856B2

(12) United States Patent
Zheng

(10) Patent No.: US 7,137,856 B2
(45) Date of Patent: Nov. 21, 2006

(54) COLLAPSIBLE MAT ASSEMBLIES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

(21) Appl. No.: 11/149,752

(22) Filed: Jun. 10, 2005

(65) Prior Publication Data

US 2005/0224106 A1 Oct. 13, 2005

Related U.S. Application Data

(63) Continuation of application No. 10/177,609, filed on Jun. 18, 2002, now Pat. No. 6,908,353.

(51) Int. Cl.
*B63C 9/08* (2006.01)

(52) U.S. Cl. ..... 441/129; 441/131

(58) Field of Classification Search ..... 441/129–132; 446/153; 472/128, 129
See application file for complete search history.

(56) References Cited

U.S. PATENT DOCUMENTS 2,959,796 A 11/1960 De Sander et al.
4,861,300 A 8/1989 Casagrande et al.
5,116,273 A * 5/1992 Chan ..... 160/370.21
5,163,461 A 11/1992 Ivanovich et al.
5,406,653 A * 4/1995 Todor ..... 4/496
6,030,300 A 2/2000 Zheng
D426,415 S 6/2000 Le Gette et al.
6,170,100 B1 1/2001 Le Gette et al.
6,192,635 B1 2/2001 Zheng
D447,661 S 9/2001 Le Gette et al.
D449,193 S 10/2001 Le Gette et al.
6,343,391 B1 2/2002 Le Gette et al.
6,485,344 B1 * 11/2002 Arias ..... 441/131

* cited by examiner

*Primary Examiner*—Ed Swinehart
(74) *Attorney, Agent, or Firm*—Raymond Sun

(57) ABSTRACT

An assembly has a foldable frame member that has a folded and an unfolded orientation, a sheet material covering portions of the frame member when the frame member is in the unfolded orientation, and one or more floatation devices. The floatation devices can be attached to any number of locations, including but not limited to the sheet material, the top of the sheet material, the bottom of the sheet material, and the periphery of the frame member.

1 Claim, 7 Drawing Sheets

COLLAPSIBLE MAT ASSEMBLIES

RELATED CASES

This is a continuation of Ser. No. 10/177,609, filed Jun. 18, 2002, now U.S. Pat. No. 6,908,353.

BACKGROUND OF THE INVENTION

1. Field of the Invention

The present invention relates to collapsible structures, and in particular, to collapsible mat assemblies which offer multiple uses, and which may be twisted and folded to reduce the overall size of the assembly to facilitate convenient storage and use.

2. Description of the Prior Art

Collapsible objects have recently become popular with both adults and children. Examples of such collapsible objects are shown and described in U.S. Pat. No. 5,038,812 (Norman), U.S. Pat. No. 5,467,794 (Zheng) and U.S. Pat. No. 5,560,385 (Zheng) in the form of collapsible structures. These structures can be used as play structures, shelters, tents, and storage structures, among other uses. These structures may be twisted and folded to reduce the overall size of the structures to facilitate convenient storage and use. As such, these structures are being enjoyed by many people in many different applications.

Other examples of collapsible objects include blanket, mat and floating assemblies as illustrated in one or more of U.S. Pat. No. 6,073,283 (Zheng), U.S. Pat. No. 6,170,100 (Le Gette et al.) and U.S. Pat. No. 6,343,391 (Le Gette et al.). These assemblies can be used as blankets, floor mats, and floating mats. These blankets and mats may be twisted and folded to reduce the overall size of the blanket or mat to facilitate convenient storage and use.

SUMMARY OF THE DISCLOSURE

It is an object of the present invention to provide an improved floating mat assembly that can be folded and collapsed into a smaller configuration for convenient storage and transportation.

It is another object of the present invention to provide a floating mat assembly that offers flexibility in use.

It is yet another object of the present invention to provide a floating mat assembly whose components can be separated for storage and cleaning.

In order to accomplish the objects of the present invention, there is provided an assembly that has a foldable frame member that has a folded and an unfolded orientation, a sheet material covering portions of the frame member when the frame member is in the unfolded orientation, and one or more floatation devices. The floatation device(s) can be attached to any number of locations, including but not limited to the sheet material, the top of the sheet material, the bottom of the sheet material, and the periphery of the frame member.

DETAILED DESCRIPTION OF THE PREFERRED EMBODIMENTS

Figure 1:
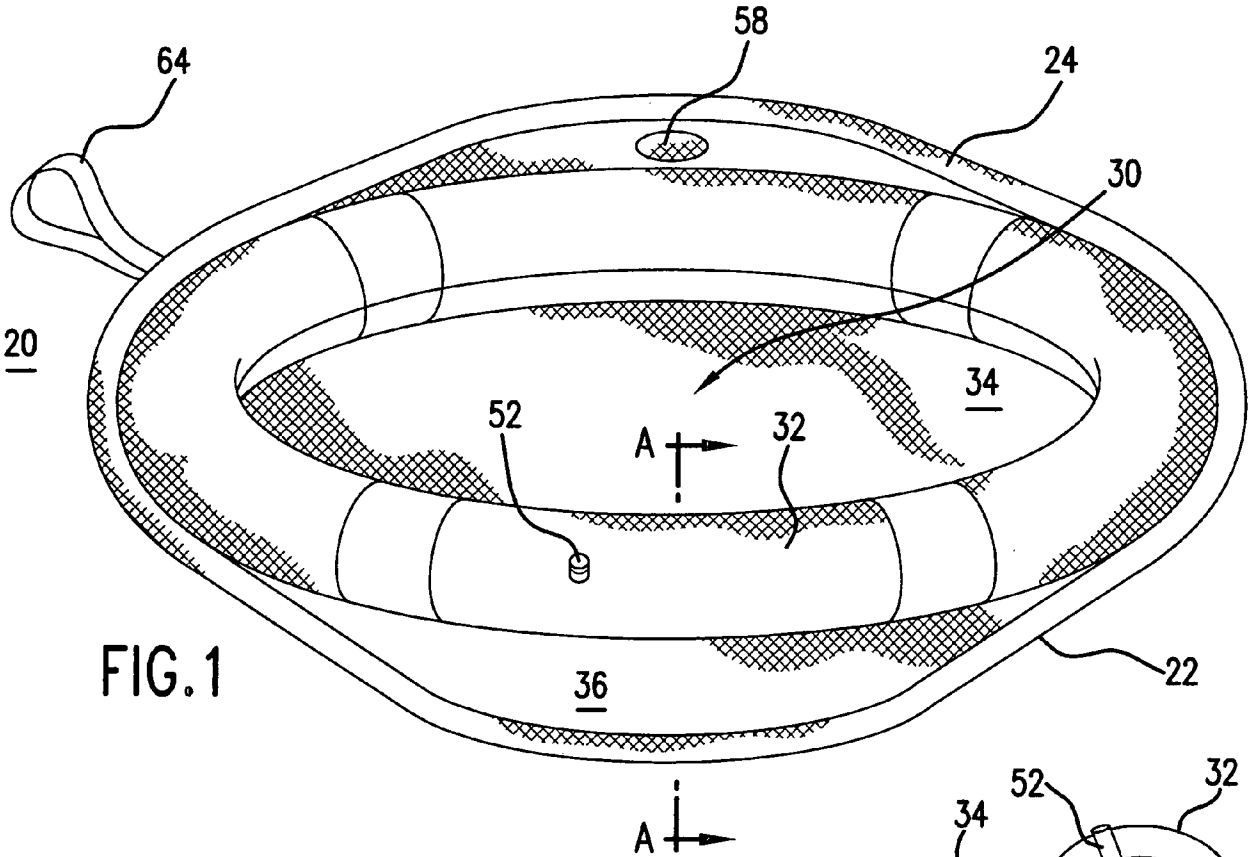
FIG. 1 is a perspective view of a floating mat assembly according to one embodiment of the present invention shown in use in its expanded configuration.
Figure 2:
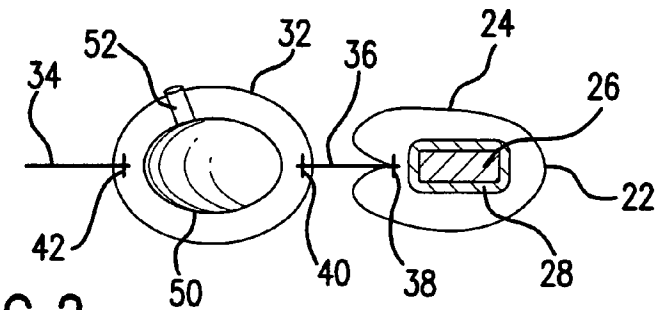
FIG. 2 is a cross-sectional view of the assembly of FIG. 1 taken along line A—A thereof.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. Referring to FIGS. 1 and 2, the present invention provides a floating mat assembly 20 that can assume any configuration, such as circular, oval, or rectangular, square, trapezoidal, or irregular. The assembly 20 has a peripheral edge 22 that extends all the way around the assembly 20. A peripheral frame retaining sleeve 24 is provided along and traverses the peripheral edge 22, and a continuous frame member 26 is retained or held within the frame retaining sleeve 24 such that the frame member 24 extends completely around the peripheral edge 22.

The continuous frame member 26 may be provided as one continuous loop, or may be a strip of material connected at both ends to form a continuous loop. The continuous frame member 26 is preferably formed of flexible coilable steel, although other materials such as plastics may also be used. The frame member 26 should be made of a material which is relatively strong and yet is flexible to a sufficient degree to allow it to be coiled. Thus, the frame member 26 is capable of assuming two positions, an open or expanded position such as shown in FIG. 1, or a folded position (see FIG. 3D) in which the frame member is collapsed into a size which is much smaller than its open position. The frame member 26 may be merely retained within the frame retaining sleeve 24 without being connected thereto. Alternatively, the frame retaining sleeve 24 may be mechanically fastened, stitched, fused, or glued to the frame member 26 to retain the frame member 26 in position. In addition, a protective covering 28 can be provided to cover the frame member 26. The protective covering 28 can be the same as that which is described in U.S. Pat. No. 5,845,697 to Zheng, whose entire disclosure is incorporated by this reference as though set forth fully herein. The protective covering 28 can be effective in preventing the metallic frame member 26 from rust and damage due to its anticipated exposure to water.

Sheet material 30 extends across the interior space defined by the sleeve 24, and is held taut by the frame member 26 when the sheet material 30 is in its open position. The term "sheet material" is to be given its broadest meaning and should be made from strong, flexible yet lightweight materials and may include woven fabrics, sheet fabrics, meshed fabrics or even films. The sheet material 30 can be water-resistant and durable to withstand the wear and tear associated with extended use, and rough treatment by adults and children. The sheet material 30 can also allow water to pass therethrough (e.g., such as a meshed material).

The sheet material 30 can be divided into different sections. For example, the sheet material 30 can be divided by a inner sleeve 32 into two separate sheet sections, an inner sheet section 34 and an outer sheet section 36. The outer sheet section 36 can be provided between the peripheral sleeve 24 and the inner sleeve 32, and the inner sheet section 34 can be provided within the interior defined by the inner sleeve 32. As illustrated best in FIG. 2, the peripheral sleeve 24 may attached to the outer sheet section 36 by a first stitching 38. The first stitching 38 can also operate to enclose the peripheral sleeve 22. Alternatively, the peripheral sleeve 24 can be a part of or an extension of the outer sheet section 36, where the outer edge of the outer sheet section 36 is wrapped around the frame member 26 to enclose the frame member 26, and then a stitching is applied to enclose the sleeve 24. In addition, the inner sleeve 32 may attached to the outer sheet section 36 by a second stitching 40, and the inner sleeve 32 may attached to the inner sheet section 34 by a third stitching 42. The second stitching 40 and the third stitching 42 can also operate to enclose the inner sleeve 32.

A floatation device 50 is retained inside the inner sleeve 32. The floatation device 50 can be embodied in any desirable structure, including but not limited to one or more foam pieces, or one or more inflatable bags. FIGS. 1 and 2 illustrate the use of an inflatable bag 50 which has a hollow interior that is adapted to receive an inflation medium (e.g., air or liquid) via a port 52 that extends through the inner sleeve 32. In the assembly 20 shown in FIG. 1, the inflatable bag 50 defines a generally oval shape that extends completely within the confines of the peripheral sleeve 24.

As an alternative, the inner sleeve 32 can be omitted and the inflatable bag 50 can be stitched directly to the sheet portions 34 and 36.

Other accessories can be provided to the assembly 20. For example, an opening 58 can be provided on the outer sheet section 36 to function as a cup holder.

In use, the user can inflate the floatation device 50 and then place the assembly 20 into a body of water (e.g., swimming pool, beach, lake, etc.). The user can then climb on to the top surface of the assembly 20 and then lie on the assembly 20 as the assembly 20 floats on the water. The user can also use the assembly 20 as a floor mat by not inflating the floatation device 50, and then merely placing the assembly 20 on the floor.

Figure 3B:
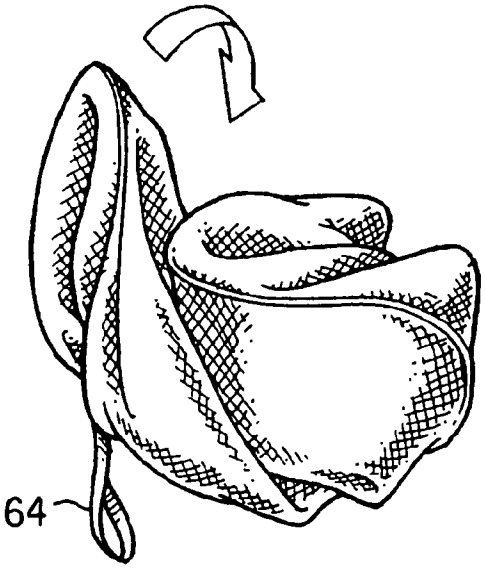
FIGS. 3A–3F illustrate how the assembly of FIG. 1 can be twisted and folded for compact storage.
Figure 3C:
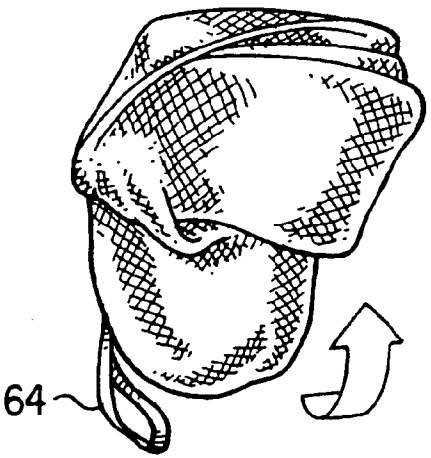
Figure 3A:
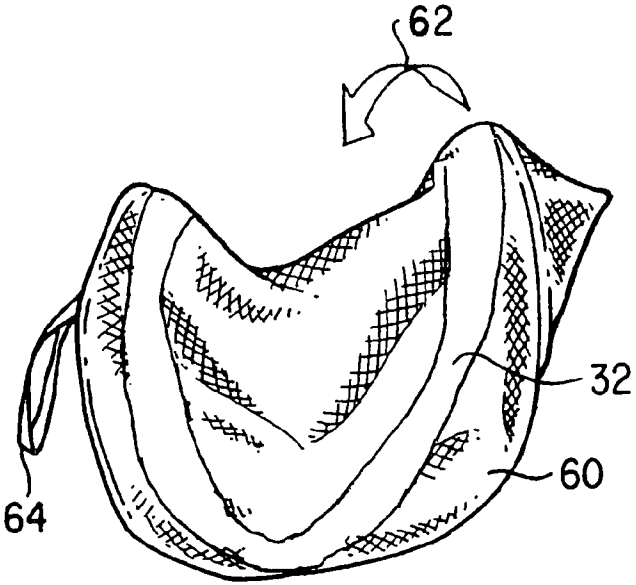
Figure 3E:
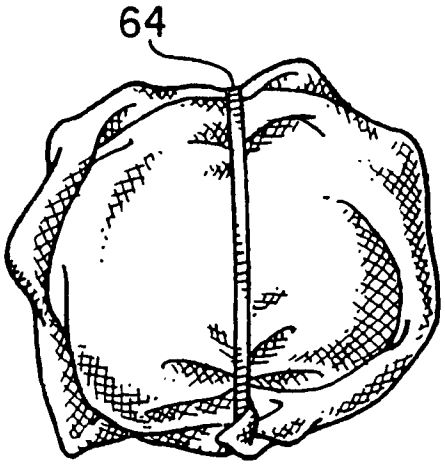

To store the assembly 20, the user first deflates the floatation device 50 so that the entire assembly 20 can have a generally flat profile. The assembly 20 can then be folded and collapsed into a compact configuration for storage, as illustrated in FIGS. 3A–3F. In the first step illustrated in FIG. 3A, the opposite border 60 of the assembly 20 is folded in (see arrow 62) to collapse the frame member 26 with the sheet material 30. As shown in FIG. 3B, the next step is to continue the collapsing so that the initial size of the assembly 20 is reduced. FIG. 3C shows the next step with the frame member 26 and sheet material 30 collapsed on each other to provide for a small essentially compact configuration having a plurality of concentric frame members 26 and layers of the sheet material 30 so that the collapsed assembly 20 has a size which is a fraction of the size of the initial assembly 20, as shown in FIG. 3D.

In addition, a retaining member or strap 64 (shown in FIGS. 3A–3E only) may be attached to the peripheral edge 22. As shown in FIGS. 3D and 3E, the strap 64 may be used to tie or hold the collapsed assembly 20 in the collapsed position. Alternatively, a bag (not shown) may be used to store the collapsed assembly 20.

Figure 3F:
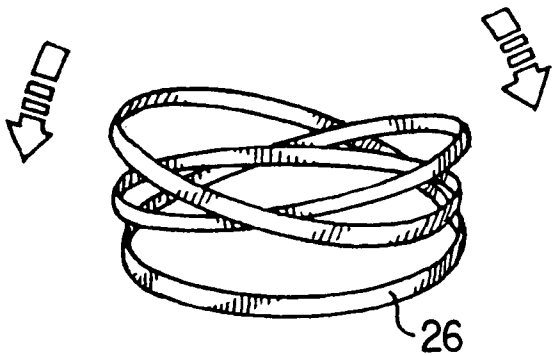
Figure 3D:
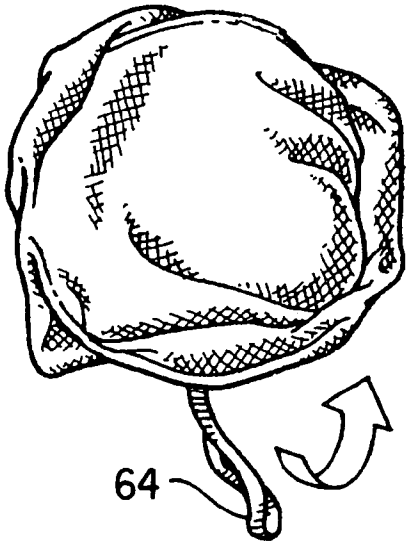

FIG. 3F illustrates the closed loop of the frame member 26 in the collapsed position. The structure of each closed loop essentially consists of two sets of three loop rings intertwined to lie flat. In the collapsed position, the structure will have a significantly reduced diameter which makes it easy to store the collapsed assembly 20. This reduced size is especially convenient when the assembly 20 is to be used away from the home, such as during travel or camping or at the beach where the assembly 20 can be easily and conveniently packed, stored and transported.

The assembly 20 can be expanded again by opening the coiled frame member 26. The bias and resiliency of the frame member 26 will cause the frame member 26 (and the attached sheet material 30) to automatically open out to the expanded position shown in FIG. 1.

Figure 4:
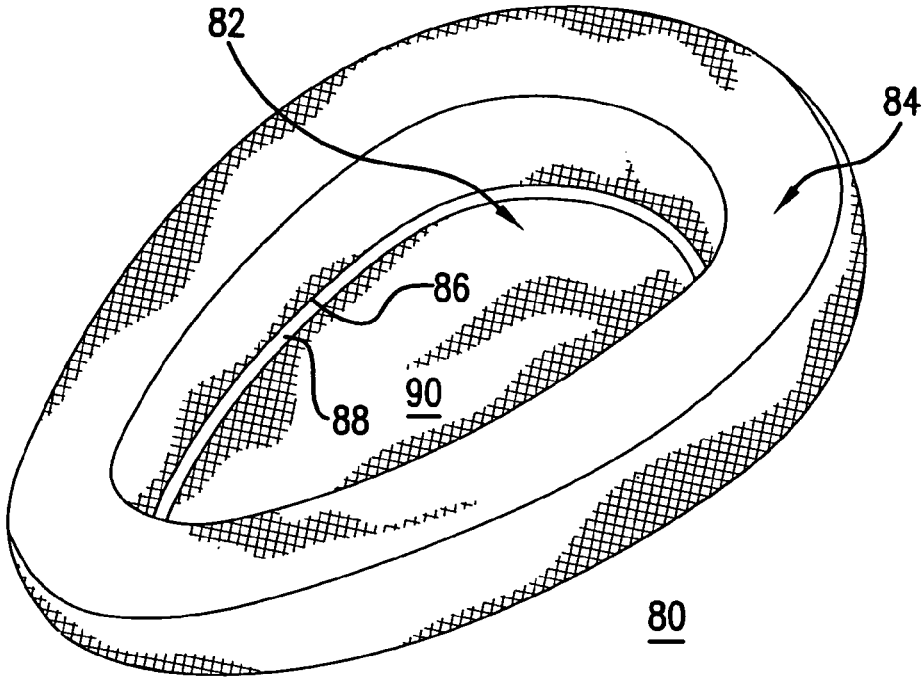
FIGS. 4–9 illustrate different embodiments of floating mat assemblies according to the present invention.

FIG. 4 illustrates another floating mat assembly 80 according to the present invention. Again, the assembly 80 can assume any configuration, such as circular, oval, rectangular, square, trapezoidal, or irregular. The assembly 80 has a panel portion 82 with a floatation device 84 attached to the peripheral edge 86 of the panel portion 82. The panel portion 82 has a peripheral frame retaining sleeve 88 that is provided along and traverses the peripheral edge 86, and a continuous frame member (which can be the same as the frame member 26) that is retained or held within the frame retaining sleeve 88 such that the frame member 26 extends completely around the peripheral edge 86. The panel portion 82 also includes a sheet material 90 that can be the same as the sheet material 30 described above. The sheet material 90 can be attached to the sleeve 88 in the same manner illustrated above in connection with sheet portion 36 and sleeve 24 in FIG. 2. The floatation device 84 can be embodied in any desirable structure, including but not limited to one or more foam pieces, or one or more inflatable bags. FIG. 4 illustrates the floatation device 84 as being provided in the form of a single floatation device that extends around the periphery of the sleeve 88. The floatation device 84 can be permanently attached (e.g., by stitching, welding or fusing), or removably attached (e.g., by hooks, VELCRO™ pads, etc.), to the peripheral edge of the sleeve 88. The assembly 80 can be deployed, stored and collapsed using the same techniques described above for the assembly 20.

Figure 5:
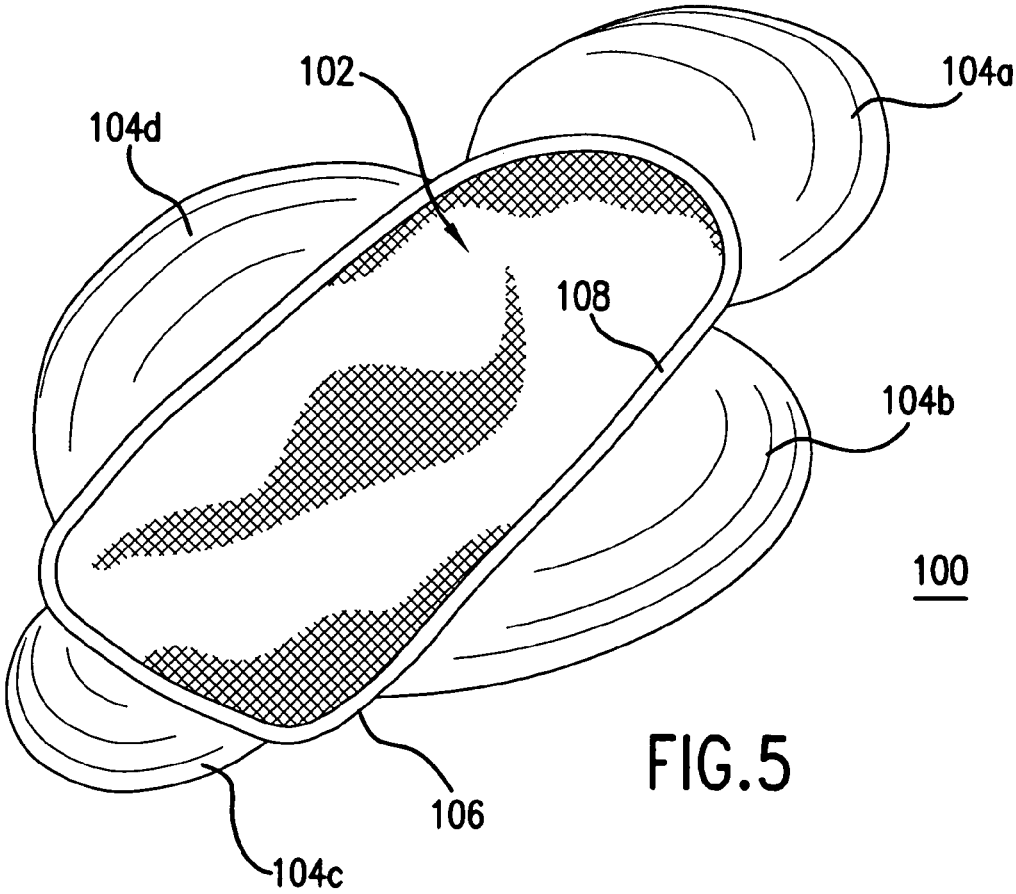

FIG. 5 illustrates an assembly 100 that is very similar to the assembly 80 in FIG. 4. The assembly 100 has a panel portion 102 with a plurality of separate floatation devices 104*a*–104*d* attached to the peripheral edge 106 of the panel portion 102. The panel portion 102 has a peripheral frame retaining sleeve 108 that is provided along and traverses the peripheral edge 106, and a continuous frame member (which can be the same as the frame member 26) that is retained or held within the frame retaining sleeve 108 such that the frame member 26 extends completely around the peripheral edge 106. The panel portion 102 also includes a sheet material 110 that can be the same as the sheet material 30 described above. The sheet material 110 can be attached to the sleeve 108 in the same manner illustrated above in connection with sheet portion 36 and sleeve 24 in FIG. 2. The floatation devices 104*a*–104*d* can be embodied in any desired shape or any desired structure, including but not limited to a plurality of separate foam pieces, or a plurality of inflatable bags. Different floatation devices 104*a*–104*d* can have different shapes and sizes. FIG. 5 illustrates a plurality of floatation devices 104*a*–104*d* that are spaced apart around the periphery of the sleeve 108. The floatation devices 104*a*–104*d* can be permanently attached (e.g., by stitching, welding or fusing), or removably attached (e.g., by hooks, VELCRO™ pads, etc.), to the peripheral edge of the sleeve 108. The assembly 100 can be deployed, stored and collapsed using the same techniques described above for the assembly 20.

The provision of a plurality of separate floatation devices 104*a*–104*d* provides the user with a wide variety of options. First, the user can use one of the floatation devices 104*a* as a pillow, and may choose to inflate that floatation device 104*a* more than the other floatation devices to provide a firmer or higher head support. Second, the user can choose to inflate the different floatation devices to varying degrees of firmness, so that portions of the assembly 100 can be slightly submerged in the water while other portions of the assembly 100 can float completely above water. For example, the user can inflate the floatation devices 104*a*, 104*b*, 104*d* more than the floatation device 104*c* so that the lower portion of the assembly 100 will be slightly submerged into the water (to allow the user's feet to be submerged in the water), while maintaining the upper portion of the assembly 100 completely above water to keep the user's head dry.

Figure 6:
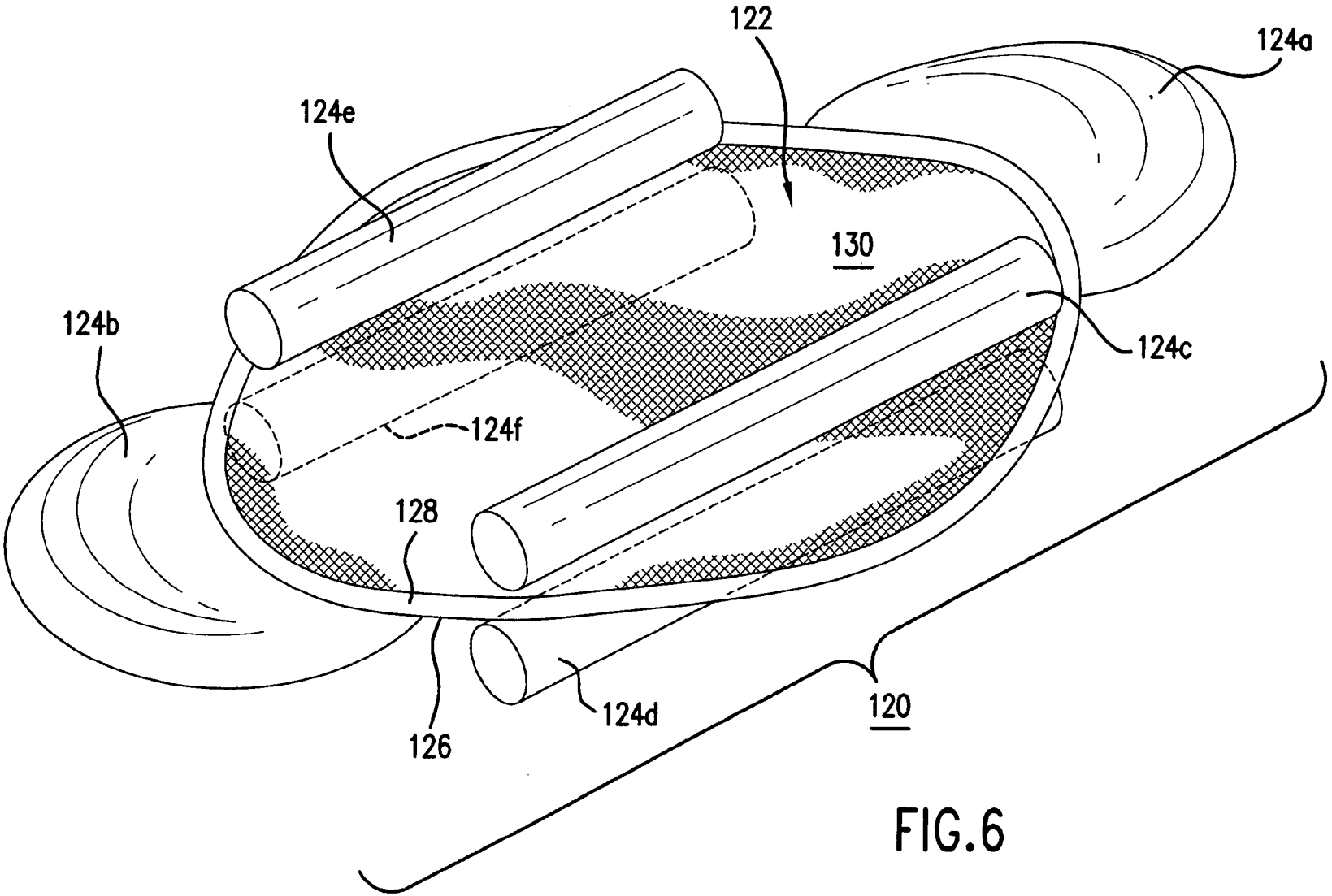

FIG. 6 illustrates an assembly 120 that is very similar to the assembly 100 in FIG. 5. The assembly 120 has a panel portion 122 with a plurality of separate floatation devices 124*a*–124*f* attached thereto. The panel portion 122 has a peripheral frame retaining sleeve 128 that is provided along and traverses the peripheral edge 126, and a continuous frame member (which can be the same as the frame member 26) that is retained or held within the frame retaining sleeve 128 such that the frame member 26 extends completely around the peripheral edge 126. The panel portion 122 also includes a sheet material 130 that can be the same as the sheet material 30 described above. The sheet material 130 can be attached to the sleeve 128 in the same manner illustrated above in connection with sheet portion 36 and sleeve 24 in FIG. 2. The floatation devices 124*a*–124*f* can be embodied in any desired shape or any desired structure, including but not limited to a plurality of separate foam pieces, or a plurality of inflatable bags. Different floatation devices 124*a*–124*f* can have different shapes and sizes.

FIG. 6 illustrates the provision of two floatation devices 124*a* and 124*b* provided along the periphery of the sleeve 128 at opposing ends of the assembly 120. In addition, two floatation devices 124*c* and 124*e* can be attached to the top surface of the sheet material 130 adjacent the sides of the assembly 120, while another two floatation devices 124*d* and 124*f* can be attached to the bottom surface of the sheet material 130 adjacent the sides of the assembly 120. The floatation devices 124*c* and 124*e* can even be aligned to be directly above the floatation devices 124*d* and 124*f*, respectively. The floatation devices 124*a*–124*f* can be permanently attached (e.g., by stitching, welding or fusing), or removably attached (e.g., by hooks, VELCRO™ pads, etc.), to the peripheral edge of the sleeve 128 or to the sheet material 130. The assembly 120 can be deployed, stored and collapsed using the same techniques described above for the assembly 20.

The provision of floatation devices 124*c*–124*f* that are above and below the panel portion 122 also allows the user to adjust the floatation characteristics of the assembly 120. For example, if the bottom floatation devices 124*e* and 124*f* are fully inflated, the assembly 120 can be supported higher above the water level. As another example, the removability of the floatation devices 124*a*–124*f* allows the user to position the floatation devices 124*a*–124*f* anywhere along the sleeve 128 or on either surface of the sheet material 130, thereby allowing the user to obtain (possibly through trial and error) the optimum floating performance given the user's particular weight and height. In addition, the adjustments discussed above for the assembly 100 apply to assembly 120 as well.

Figure 7:
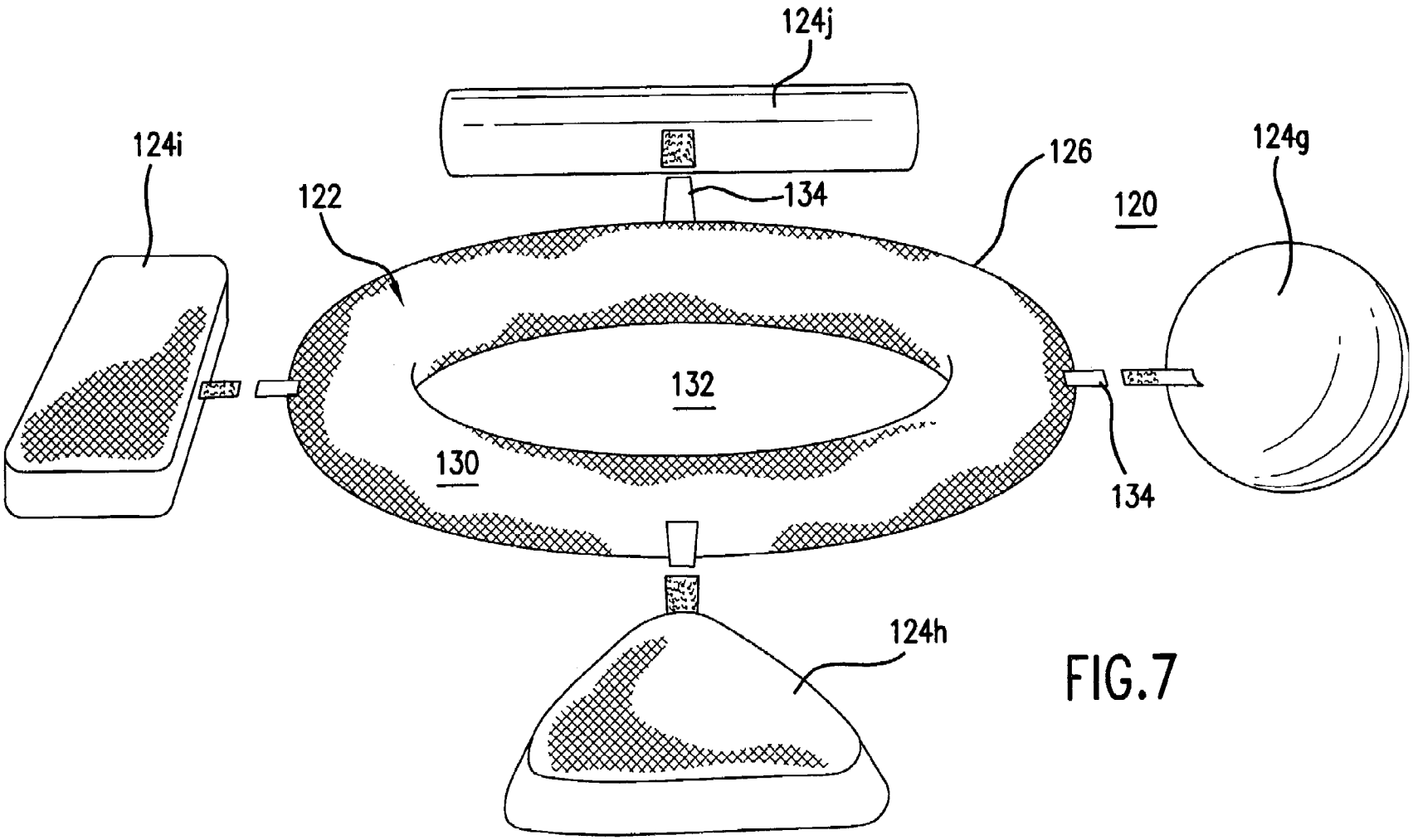

FIG. 7 illustrates modifications that can be made to the assembly 120 of FIG. 6. For example, a large internal opening 132 can be provided in the sheet material 130. The internal opening 132 allows water to pass therethrough to contact the user's back, buttocks and legs which can provide a desirable cooling effect on hot days. In addition, FIG. 7 illustrates the provision of floatation devices 124*g*–124*j* that have different shapes and sizes, and the use of VELCRO™ pads 134 to removably attach the floatation devices 124*g*–124*j* to the panel portion 122.

Figure 8:
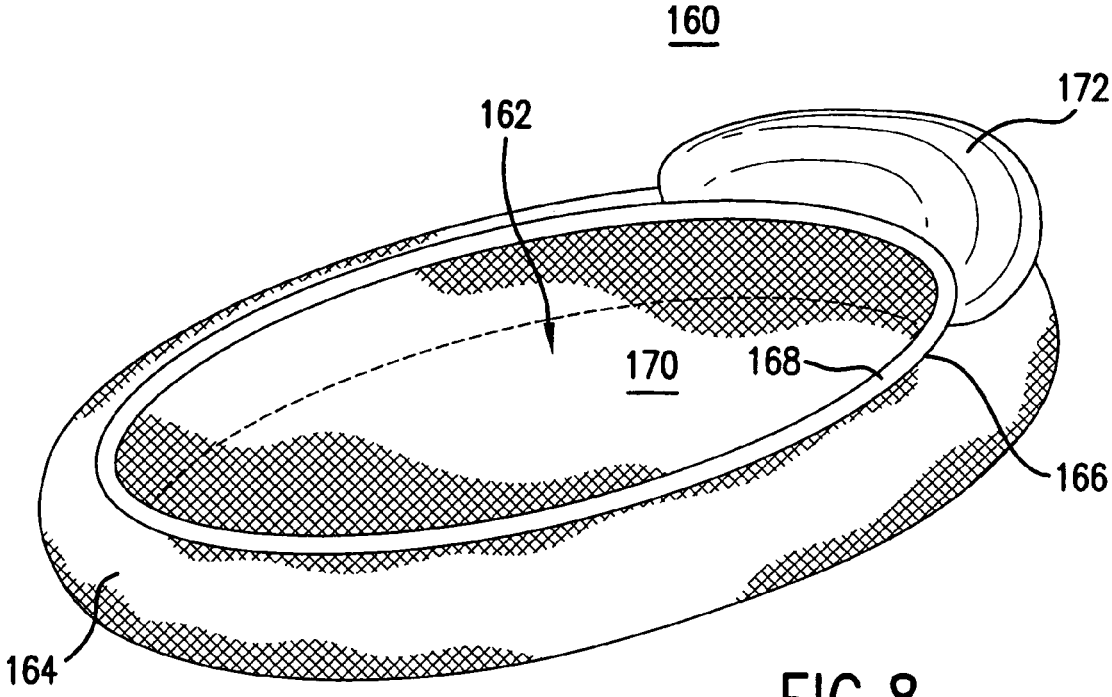

FIG. 8 illustrates yet another floating mat assembly 160 according to the present invention. Again, the assembly 160 can assume any configuration, such as circular, oval, rectangular, square, trapezoidal, or irregular. The assembly 160 has a panel portion 162 with a floatation device 164 attached below the panel portion 162. The panel portion 162 has a peripheral frame retaining sleeve 168 that is provided along and traverses the peripheral edge 166, and a continuous frame member (which can be the same as the frame member 26) that is retained or held within the frame retaining sleeve 168 such that the frame member 26 extends completely around the peripheral edge 166. The panel portion 162 also includes a sheet material 170 that can be the same as the sheet material 30 described above. The sheet material 170 can be attached to the sleeve 168 in the same manner illustrated above in connection with sheet portion 36 and sleeve 24 in FIG. 2. The floatation device 164 can be embodied in any desirable structure, including but not limited to one or more foam pieces, or one or more inflatable bags. FIG. 8 illustrates the floatation device 164 as being provided in the form of a single floatation device that has the same general shape and size as the panel portion 162, and which can be permanently attached (e.g., by stitching, welding or fusing), or removably attached (e.g., by hooks, VELCRO™ pads, etc.), to the bottom surface of the panel portion 162. In addition, an optional inflatable pillow 172 (which can itself be a floatation device) can be either permanently or removably attached to the panel portion 162 adjacent one end thereof. The assembly 160 can be deployed, stored and collapsed using the same techniques described above for the assembly 20.

Figure 9:
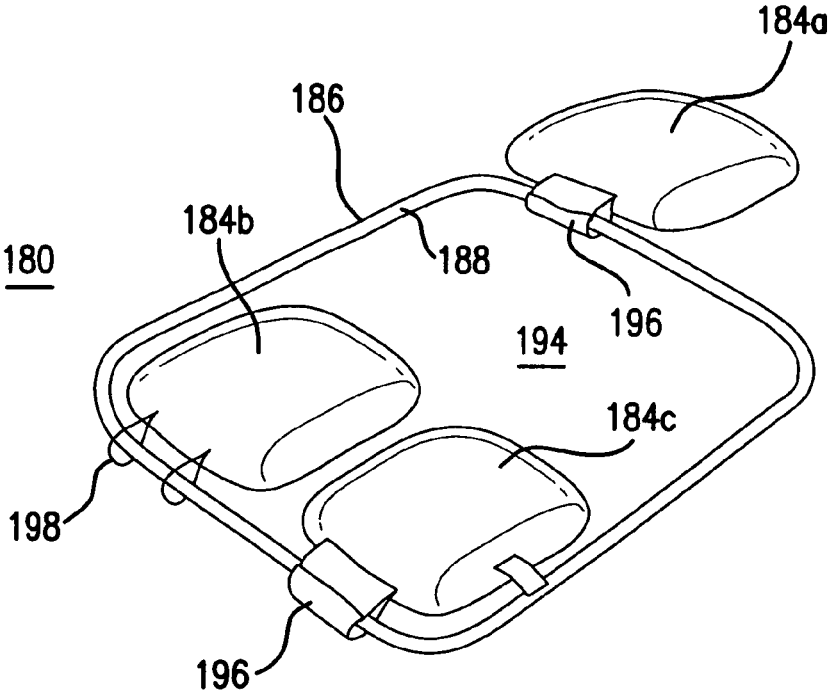

FIG. 9 illustrates yet another floating mat assembly 180 according to the present invention. Again, the assembly 180 can assume any configuration, such as circular, oval, rectangular, square, diamond, trapezoidal, or irregular. The assembly 180 has a peripheral frame retaining sleeve 188 that is provided along and traverses the peripheral edge 186, and a continuous frame member (which can be the same as the frame member 26) that is retained or held within the frame retaining sleeve 188 such that the frame member 26 extends completely around the peripheral edge 186. Unlike the other embodiments illustrated in FIGS. 1–8, the assembly 180 does not have any sheet material that extends in the interior of the sleeve 188. As a result, the interior of the sleeve defines an opening 194. One or more floatation devices 184*a*–184*c* can be attached to any selected location along the sleeve 188. The floatation devices 184*a*–184*c* can be embodied in any desirable structure, including but not limited to one or more foam pieces, or one or more inflatable bags. FIG. 9 illustrates a floatation device 184*a* that can be attached, either permanently (e.g., via stitching or loops) or removably (e.g., via hooks or a VELCRO™ sleeve 196 as shown), to one side edge of the sleeve 188 in a manner such that the floatation device 184*a* extends outside the periphery defined by the sleeve 188. FIG. 9 also illustrates floatation devices 184*b*, 184*c* that can be attached, either permanently (e.g., via stitching or loops 198 as shown) or removably (e.g., via hooks or a VELCRO™ sleeve 196 as shown), to other side edges of the sleeve 188 in a manner such that the floatation devices 184*b* and 184*c* extend inside the periphery defined by the sleeve 188. One or more of these floatation devices 184*a*–184*c* can be used as a pillow. The assembly

180 can be deployed, stored and collapsed using the same techniques described above for the assembly 20.

The assemblies 100, 120 and 160 provide the user with the flexibility of using only the panel portion 102, 122 and 162, respectively, as a mat, independent of the floatation device(s) associated therewith.

In addition, in the present invention, any of the floatation devices can be used as a pillow to support a user's head. For example, in the assemblies 20 and 80, any portion of the floatation devices 50 and 84 can be used as pillow to support a user's head. Similarly, any of the separate floatation devices in FIGS. 5–9 can be used as a pillow.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A method of deploying a collapsible floating assembly, comprising:

a. providing an assembly, comprising:

a foldable frame member that has a folded and an unfolded orientation, the frame member defining a periphery for the assembly;

a sheet material covering portions of the frame member when the frame member is in the unfolded orientation;

a first inflatable floatation device coupled to the sheet material or the frame member;

a second inflatable floatation device coupled to the sheet material or the frame member at a location that is separate from, and spaced apart from, the first inflatable floatation device;

ii. while the frame member is in the unfolded orientation, varying the inflation of the first and second inflatable floatation devices so that the assembly is partially submerged in water at the location of the second inflatable floatation device and the assembly is supported entirely above water at the location of the first inflatable floatation device when the assembly is placed in a body of water; and iii. twisting and folding the frame member to the folded orientation where the frame member forms a plurality of concentric frame members.

* * * * *